US006813880B2

(12) United States Patent
Nishiyama et al.

(10) Patent No.: US 6,813,880 B2
(45) Date of Patent: Nov. 9, 2004

(54) FUEL INJECTION CONTROLLING APPARATUS FOR ENGINE

(75) Inventors: Toshihiko Nishiyama, Oyama (JP); Koutarou Wakamoto, Oyama (JP)

(73) Assignee: Komatsu Ltd., Tokyo (JP)

( * ) Notice: Subject to any disclaimer, the term of this patent is extended or adjusted under 35 U.S.C. 154(b) by 37 days.

(21) Appl. No.: 10/101,866

(22) Filed: Mar. 21, 2002

(65) Prior Publication Data

US 2002/0134073 A1 Sep. 26, 2002

(30) Foreign Application Priority Data

Mar. 22, 2001 (JP) ..... 2001-081962

(51) Int. Cl.[7] ..... F01N 3/00

(52) U.S. Cl. ..... 60/285; 60/278; 60/295; 60/301; 123/431

(58) Field of Search ..... 60/285, 295, 301, 60/278; 123/431

(56) References Cited

U.S. PATENT DOCUMENTS 4,084,549 A * 4/1978 Satow ..... 123/217
5,063,886 A * 11/1991 Kanamaru et al. ..... 123/65 VD
5,291,865 A * 3/1994 Sasaki ..... 123/298
5,313,920 A * 5/1994 Matsushita ..... 123/295
5,357,925 A * 10/1994 Sasaki ..... 123/298
5,520,157 A * 5/1996 Pontoppidan ..... 123/531
5,603,301 A * 2/1997 Sakurai et al. ..... 123/430
5,720,259 A * 2/1998 Sakurai et al. ..... 123/432
5,894,728 A * 4/1999 Wakamoto ..... 60/286
6,314,940 B1 * 11/2001 Frey et al. ..... 123/431
6,340,014 B1 * 1/2002 Tomita et al. ..... 123/295

* cited by examiner

*Primary Examiner*—Thomas Denion
*Assistant Examiner*—Diem Tran
(74) *Attorney, Agent, or Firm*—Varndell & Varndell, PLLC

(57) ABSTRACT

The invention provides a fuel injection controlling apparatus for an engine that reduces NOx amounts in an exhaust gas of a Diesel engine conducting lean combustion. An inter-cylinder injector (20*a*) is arranged in each cylinder of an engine (1). An intake port/manifold injector (21*a*) is arranged at an inlet of each cylinder of an intake manifold (5). A speed sensor (32) for detecting the engine speed is provided to the engine. A controller (31) is connected to the speed sensor (32), the inter-cylinder injector (20*a*) and the intake port/manifold injector (21*a*), and calculates an engine load. The intake port/manifold injector (21*a*) injects the fuel when the engine load is low, and the inter-cylinder injector (20*a*) injects the fuel when the engine load is high.

10 Claims, 4 Drawing Sheets

FUEL INJECTION CONTROLLING APPARATUS FOR ENGINE

BACKGROUND OF THE INVENTION

1. Field of the Invention

This invention relates to a fuel injection controlling apparatus for reducing NOx amounts in an exhaust gas of a Diesel engine that executes lean combustion.

2. Description of the Related Art

Various proposals have been made in the past to reduce amounts of NOx contained in an exhaust gas of a Diesel engine. For instance, Japanese Patent Laid-Open Nos. 218920/1996 and 358717/1992 describe one of such proposals.

The proposal described in Japanese Patent Laid-Open No. 218920/1996 arranges a NOx absorbing agent that normally absorbs NOx, renders an air-fuel ratio of an exhaust gas rich, and emits and reduces NOx when the built-up amount exceeds a limit. When NOx is to be emitted from the NOx absorbing agent, an engine control circuit lowers an operation air excess ratio. At the same time, this control circuit advances fuel injection timing, increases a fuel amount to be injected into a combustion chamber before ignition from a fuel injection valve, and switches a combustion condition of the engine from a combustion condition mainly of normal diffusion combustion to a combustion condition mainly of pre-mixing combustion. In this way, this technology lowers the air excess ratio without generating smoke, renders the air-fuel ratio of the exhaust gas rich and conducts emission of NOx absorbed by the NOx absorbing agent and reduction-purification.

The technology described in Japanese Patent Laid-Open No. 358717/1992 arranges a catalyst converter for reducing NOx and a lean sensor inside an exhaust passage of a Diesel engine. There are also arranged an inter-cylinder injector for injecting a fuel into a cylinder and an intake system injector for injecting the fuel into an intake system. The inter-cylinder injector injects the fuel into the cylinder during the normal operation. When NOx is emitted from the catalyst converter and is reduced, the amount of the fuel to be injected from the intake system injector is calculated from an engine load and the NOx amount. The intake system injector injects the fuel into the intake system on the basis of the calculation result in addition to fuel injection from the inter-cylinder injector, renders the air-fuel ratio of the exhaust rich and supplies HC required by the catalyst converter for reducing NOx.

However, the constructions described above involve the following problems.

In the construction described in Japanese Patent Laid-Open No. 218920/1996, the fuel amount injected into the combustion chamber from the fuel injection valve before ignition is increased by advancing the fuel injection timing so as to switch the engine combustion from the combustion mainly of diffusion combustion to the combustion mainly of pre-mixing combustion. In other words, the fuel is injected under the state where a piston position is low. In consequence, large amounts of the fuel directly adhere to the inner wall of a cylinder liner and are carbonized to thereby increase soot in oil. Since large amounts of the fuel are injected into the cylinder within a short time, mixing of air and the fuel does not easily become uniform, and fuel consumption gets deteriorated.

In the construction described in Japanese Patent Laid-Open No. 358717/1992, the inter-cylinder injector injects the fuel during the engine operation and diffusion combustion is made. When the catalyst converter requires HC for reducing NOx, the intake system injector further injects the fuel to the intake system. Therefore, large amounts of NOx are emitted even in a low engine load zone, and the scale of the catalyst converter must be increased. In addition, the amount of the fuel injected to the intake system increases and fuel consumption gets deteriorated.

SUMMARY OF THE INVENTION

In view of the problems described above, the invention is directed to provide a fuel engine injection controlling apparatus for an engine that decreases the amount of NOx in the exhaust and needs less fuel consumption.

To accomplish the object described above, the first invention of this invention provides a fuel injection controlling apparatus for a Diesel engine including first fuel injection means for supplying a fuel into cylinders and second fuel injection means for supplying the fuel to an intake passage, for conducting lean combustion under a normal operating condition, the fuel injection controlling apparatus comprising: engine load detection means; and a controller for inputting a detection signal from the engine load detection means, and causing the first fuel injection means to inject the fuel into the cylinders when an engine load is in a high load zone and the second fuel injection means to inject the fuel into the intake passage when the engine load is in a low load zone.

According to the first invention, in the Diesel engine including the first fuel injection means provided to the cylinder and the second fuel injection means provided to the intake passage, the second fuel injection means injects the fuel in the low engine load zone. Therefore, pre-mixing uniform combustion can be acquired in the low load zone, and the generation amounts of NOx can be drastically reduced. In the high load zone, on the other hand, the first fuel injection means injects the fuel into the cylinders. Therefore, stable combustion can be acquired.

In the first invention described above, the second invention employs the construction equipped with a controller for causing both of the first and second fuel injection means to inject the fuel when the engine load exists in a predetermined boundary zone between the high load zone and the low load zone.

According to the second invention, the fuel is injected to both of the cylinder and the intake passage in the predetermined boundary zone between the high load zone and the low load zone. Therefore, when the engine load passes by the boundary between the high load zone and the low load zone, a drastic change between combustion by the injection into the cylinder and combustion by injection into the intake passage can be mitigated, the occurrence of torque fluctuation becomes less and a smooth engine operation can be conducted.

In the first or second invention described above, the third invention employs the construction including a NOx absorption/reduction catalyst disposed in an exhaust pipe, for absorbing NOx when an air-fuel ratio of an exhaust gas is lean, and emitting NOx when the air-fuel ratio of the exhaust gas is rich; and a controller for causing the second fuel injection means to inject a predetermined amount of the fuel into the intake passage so that the air-fuel ratio of the exhaust gas attains a value approximate to a theoretical mixing ratio when the NOx absorption/reduction catalyst emits NOx.

The third invention includes the NOx absorption/reduction catalyst in addition to the fuel injection controlling apparatus having a small amount of NOx in the exhaust gas at the low engine load. Therefore, the NOx absorption/reduction catalyst need not be big in size. When the air-fuel ratio of the exhaust gas is rendered rich in the low load zone, the second fuel injection means injects the fuel into the intake passage so that the air-fuel ratio attains a ratio approximate to the theoretical mixing ratio. Since a uniform air-fuel mixture can be obtained and pre-mixing combustion is conducted, the generation amounts of NOx can be reduced, and deterioration of a fuel consumption ratio and abnormal high temperature inside the combustion chamber can be avoided.

In the first to third inventions described above, the fourth invention includes intake throttle means for decreasing the intake air amount or/and exhaust throttle means.

The fourth invention can decrease the intake air amount when intake air is throttled. Therefore, the overall air amount becomes small, and deterioration of the fuel consumption ratio when the air-fuel ratio of the exhaust gas is rendered rich can be further decreased.

In the first to fourth inventions, the fifth invention includes an exhaust gas-recirculation device for mixing the exhaust gas to intake air.

Since the exhaust gas-recirculation device is disposed according to the fifth invention, the air-fuel ratio of the exhaust gas can be rendered rich when the exhaust gas is recirculated. Therefore, the fuel injection amount can be further reduced and combustion can be stabilized.

DESCRIPTION OF THE PREFERRED EMBODIMENTS

Fuel injection controlling apparatuses for an engine according to preferred embodiments of the invention will be described in detail with reference to the accompanying drawings.

Figure 1:
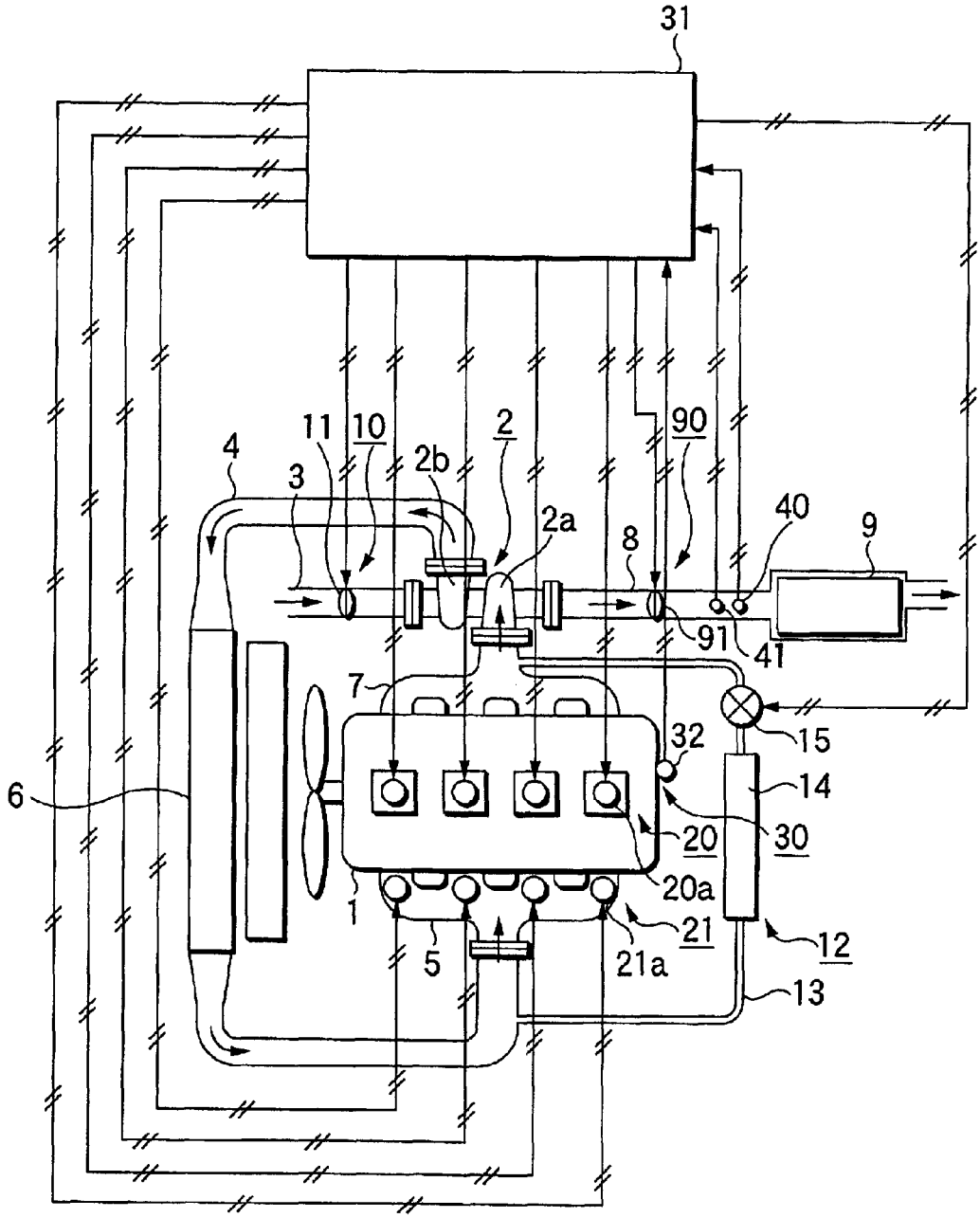
FIG. 1 is a conceptual view of a Diesel engine with a denitration device, which engine has a fuel injection controlling apparatus for an engine according to a first embodiment of the invention.

FIG. 1 is a conceptual view of a Diesel engine with a denitration device, which engine has a fuel injection controlling apparatus for an engine according to the first embodiment of the invention. An engine 1 includes a turbo charger 2. The turbo charger 2 includes an exhaust turbine 2*a* and a compressor 2*b*. The exhaust turbine 2*a* is fitted to an exhaust manifold 7. An exhaust pipe 8 is fitted to an exhaust port of the exhaust manifold 7. A NOx absorption/reduction catalyst 9 is inserted to the exhaust pipe 8. An intake pipe 3 is fitted to an intake port of the compressor 2*b* interconnected to the exhaust turbine 2*a*. An intake throttle valve 11 that constitutes intake throttle means 10 capable of regulating an open area is fitted to the intake pipe 3. A feed pipe 4 is fitted to the exhaust port of the compressor 2*b* and is thence connected to the intake manifold 5. An inter-cooler 6 is inserted into the feed pipe 4. The part of the feed pipe downstream of the inter-cooler 6 and the part of the exhaust manifold 7 upstream of the exhaust turbine 2*a* are connected to each other through an exhaust recirculation circuit 13. A recirculation circuit regulating valve (hereinafter called "EGR valve") 15 capable of regulating the open area of the exhaust recirculation circuit 13 and a recirculation gas cooler 14 are mounted onto the exhaust recirculation circuit 13. They together constitute an exhaust gas recirculation device 12. An exhaust throttle valve 91 that constitutes exhaust throttle means 90 capable of regulating the opening area is provided to the exhaust pipe 8. A NOx sensor 40 for detecting the amount of NOx and an $O_2$ sensor 41 for detecting the amount of oxygen are disposed in the exhaust pipe 8. A speed sensor 32 for detecting the engine speed is fitted to the engine 1. An inter-cylinder injector 20*a* constituting first fuel injection means 20 is arranged in each cylinder of the engine 1. An intake port/manifold injector 21*a* constituting second fuel injection means 21 is arranged at an inlet for each cylinder of the intake manifold 5. A controller 31 is connected to the inter-cylinder injector 20*a*, the inter-intake manifold injector 21*a* and the speed sensor 32, and constitutes the engine load detection means 30. A controller 31 is connected to each of the NOx sensor 40, the $O_2$ sensor 41, the intake throttle valve 11 and the EGR valve 15. Inputting the detection signal from each sensor described above, the controller 31 executes a predetermined arithmetic operation and outputs a control signal to each of the inter-cylinder injector 20*a*, the inter-intake manifold injector 21*a*, the intake throttle valve 11 and the EGR valve 15.

Next, the engine 1 operation will be explained. The compressor 2*b* is driven by the exhaust turbine 2*a*, sucks intake air from the intake pipe 3 and pressure-feeds compressed air to the intake manifold 5 through the feed pipe 4. In the interim, the inter-cooler 6 cools compressed air, and after the density is enhanced, compressed air is supplied to the intake manifold 5 of the engine 1. The controller 31 outputs the control signal to the inter-cylinder injector 20*a* and/or the inter-intake manifold injector 21*a* and lets the injector (20*a* and/or 21*a*) inject the fuel. A boundary zone is in advance secured at a boundary portion between a low load zone of the engine 1 and its high load zone. When the engine load exists in the boundary zone, the controller 31 outputs the control signal to both of the inter-cylinder injector 20*a* and the inter-intake manifold injector 21*a* and lets them inject the fuel. The inter-cylinder injector 20*a* and the inter-intake manifold injector 21*a* inject the fuel in accordance with the piston position, respectively. A NOx absorption/reduction catalyst 9 absorbs NOx that is emitted, during the normal operation. When the built-up amount in the NOx absorption/reduction catalyst 9 reaches a predetermined amount, the air-fuel ratio of the exhaust gas is changed to the rich side, and the NOx absorption/reduction catalyst emits and reduces NOx. To render the air-fuel ratio of the exhaust gas rich, the controller 31 outputs the control signal to the intake throttle valve 11 and to the EGR valve 15, throttles the throttle valve 11 to decrease the open area of the intake pipe 3 and opens the EGR valve 15 to recycle the exhaust gas into the feed pipe 4. Whenever necessary, the controller 31 further outputs the control signal to the inter-cylinder injector 20*a* or to the inter-intake manifold injector 21*a* to let it inject the fuel. The controller 31 may output the control signal to the exhaust throttle valve 91 and throttles this throttle valve 91 to decrease the open area of the exhaust pipe 8 instead of throttling the intake throttle valve 11 to decrease the open area of the intake pipe 3 as described above. Alternatively, the controller 31 may output the control signal to both of the intake throttle valve 11 and the exhaust throttle valve 91 and may simultaneously throttle them to decrease the open areas of both intake pipe 3 and exhaust pipe 8.

Figure 2:
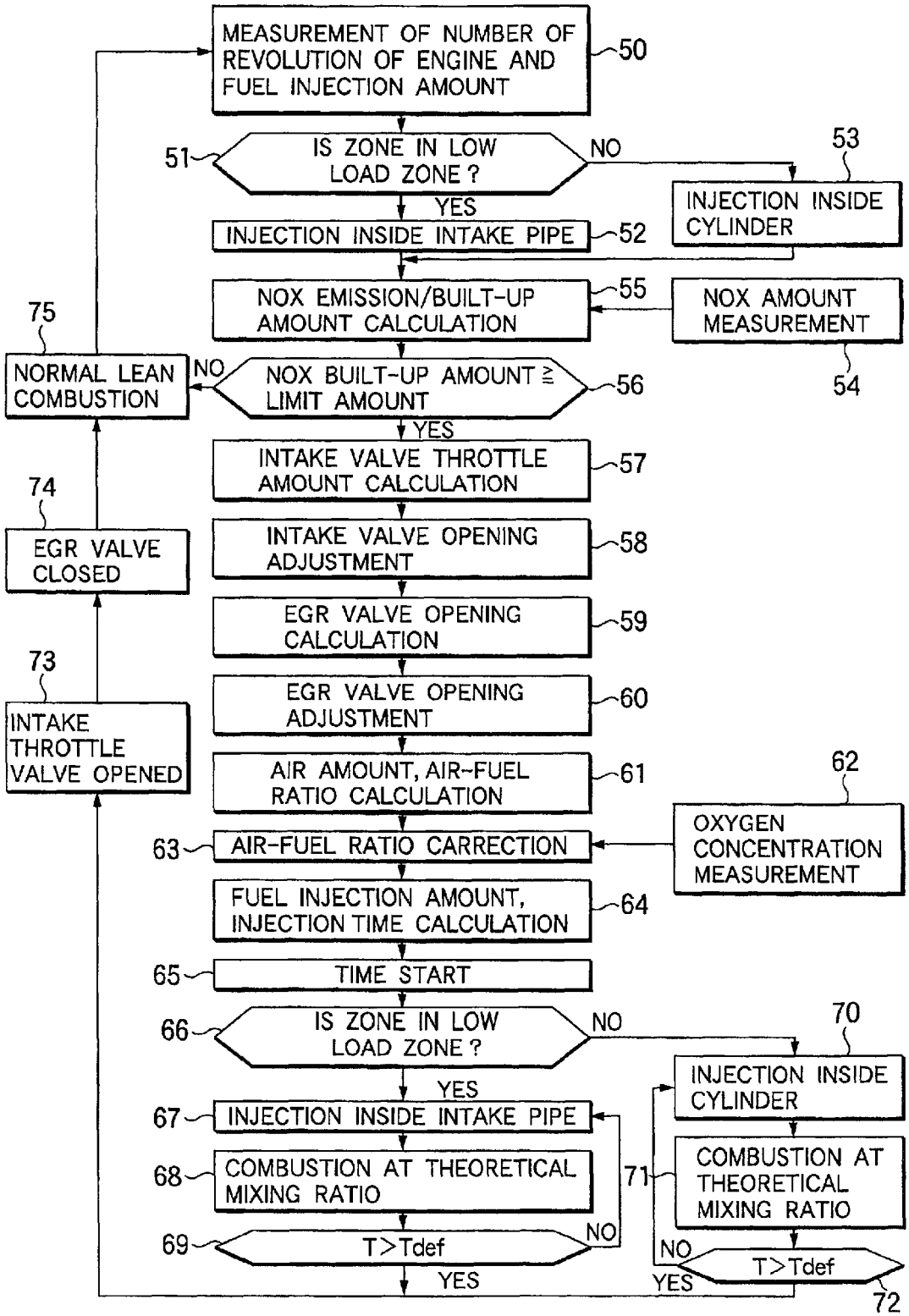
FIG. 2 is a flowchart of fuel injection control and a denitration process.

Fuel injection control and a denitration process of a Diesel engine with an exhaust denitration device, that includes the fuel injection controller according to the first embodiment, will be described in detail with reference to the flowchart shown in FIG. 2.

In Step 50, the speed sensor 32 measures the engine speed and the controller 31 measures the fuel injection amount.

In Step 51, the controller 31 calculates the engine load from the engine speed and the fuel injection amount, and judges whether or not the load zone is in the low load zone.

When the judgment result proves YES in Step 51, that is, when the load zone is in the low load zone, the flow proceeds to Step 52, and the controller 31 outputs the control signal to the inter-intake manifold injector 21*a* and lets it inject the fuel inside the intake manifold 5.

When the judgment result proves NO in Step 51, that is, when the load zone is in the high load zone, the flow proceeds to Step 53, and the controller 31 outputs the control signal to the inter-cylinder injector 20*a* and lets it inject the fuel inside the cylinder.

In Step 54, the NOx sensor 40 measures the NOx emission amount and outputs the measurement value to the controller 31.

In Step 55, the controller 31 calculates the NOx built-up amount of the NOx absorption/reduction catalyst 9 from the measurement result of the NOx emission amount.

In Step 56, the controller 31 judges whether or not the NOx amount built up in the NOx absorption/reduction catalyst 9 reaches a built-up limit amount.

When the judgment result proves NO in Step 56, that is, when the NOx built-up amount of the NOx absorption/reduction catalyst 9 does not reach the limit value, the flow proceeds to Step 75, where the engine continues to conduct ordinary lean combustion, and the flow then returns to Step 50.

When the judgment result proves YES in Step 56, that is, when the NOx built-up amount of the NOx absorption/reduction catalyst 9 reaches the limit value, the flow proceeds to Step 57, where the controller 31 calculates the throttle amount of the intake throttle valve 11.

In Step 58, the controller 31 outputs the control signal to the intake throttle valve 11 and regulates the opening of the intake throttle valve 11 in accordance with the calculation value.

In Step 59, the controller 31 calculates the opening of the EGR valve 15.

In Step 60, the controller 31 outputs the control signal to the EGR valve 15 and regulates the opening of this EGR valve 15 in accordance with the calculation value.

In Step 61, the controller 31 calculates the air amount and the air-fuel ratio.

In Step 62, the $O_2$ sensor 41 measures the oxygen concentration and outputs the measurement value to the controller 31.

In Step 63, the controller 31 corrects the air-fuel ratio on the basis of the measurement result of the oxygen concentration.

In Step 64, the controller 31 calculates the fuel injection amount and the injection time Tdef for achieving the exhaust gas air-fuel ratio necessary for allowing the engine to conduct theoretical mixing ratio combustion.

In Step 65, the controller 31 starts a timer set to the injection time Tdef.

In Step 66, the controller 31 judges whether or not the engine load is in the low load zone.

When the result proves YES in Step 66, that is, when the engine load is in the low load zone, the flow proceeds to Step 67, where the controller 31 outputs the control signal to the inter-intake manifold cylinder 21*a* and lets it inject the fuel into the manifold 5.

In Step 68, the engine conducts theoretical mixing ratio combustion.

In Step 69, the controller 31 judges whether or not the fuel injection time T exceeds Tdef. When the result proves NO, the flow returns to Step 67.

When the result proves NO in Step 66, that is, when the engine load is in the high load zone, the flow proceeds to Step 70, where the controller 31 outputs the control signal to the inter-cylinder injector 20*a* and lets it inject the fuel into the cylinder.

In Step 71, the engine conducts theoretical mixing ratio combustion.

In Step 72, the controller 31 judges whether or not the fuel injection time T exceeds Tdef. When the result proves NO, the flow returns to Step 70.

When the result proves YES in Step 69 or 72, the flow proceeds to Step 73, and the intake throttle valve 11 is opened.

In Step 74, the controller 31 closes the EGR valve 15.

In Step 75, the engine returns to normal lean combustion, and the flow returns to Step 50.

In Step 57, the controller 31 may calculate the throttle amounts of both intake and exhaust throttle valves 11 and 91 instead of calculating the throttle amount of the intake throttle valve 11. In Step 58, the controller 31 may output the control signals to both intake and exhaust throttle valves 11 and 91 and may regulate the opening of these throttle valves 11 and 91 in accordance with the calculation values.

The Diesel engine with the exhaust denitration device that includes the fuel injection controlling apparatus according to the invention is operated in the operation sequence and in the de NOx process described above, and provides the following effects.

When the engine load is low, the inter-intake manifold injector 21*a* injects the fuel into the intake manifold 5 and pre-mixture uniform combustion is made. Consequently, the NOx amounts in the exhaust can be drastically reduced. When the engine load is high, the inter-cylinder injector 20*a* injects the fuel into the cylinder and stable combustion can be acquired.

The boundary zone is secured at the boundary portion between the low engine load zone and the high engine load zone. When the engine load exists in this boundary zone, both inter-intake manifold injector 21*a* and the inter-cylinder injector 20*a* inject the fuel. Therefore, when the engine load passes by the boundary between the low load zone and the high load zone, the drastic change between combustion by the inter-intake manifold injector 21*a* and combustion by the inter-cylinder injector 20*a* can be mitigated, and the smooth operation can be conducted without less torque fluctuation.

The NOx absorption/reduction catalyst 9 is arranged on the passage of the exhaust pipe 8 of the engine equipped with the fuel injection apparatus described above. Because the NOx amounts in the exhaust gas are small in the low load zone, the NOx absorption/reduction catalyst 9 can be rendered compact. When the NOx absorption/reduction catalyst 9 emits NOx at the low engine load, the inter-intake manifold injector 21*a* injects the fuel. Therefore, pre-mixing uniform combustion can be acquired when the air-fuel ratio of the exhaust gas is rendered rich at the low engine load, the generation amount of NOx can be reduced, and deterioration of fuel consumption and abnormal high temperature inside the combustion chamber can be avoided.

The intake throttle valve 11 is arranged in the intake pipe 3 so as to throttle the passage of the intake pipe 3 when the air-fuel ratio of the exhaust gas is rendered rich. Therefore, the overall air amount can be reduced and deterioration of the fuel consumption ratio at a high air-fuel ratio can be further improved. The exhaust throttle valve 91 is disposed in the exhaust pipe 8 to throttle the passage of the exhaust pipe 8 when the air-fuel ratio of the exhaust gas is rendered rich. Therefore, the overall air amount can be reduced and deterioration of the fuel consumption ratio at a high air-fuel ratio can be further improved. The intake throttle valve 11 and the exhaust throttle valve 91 are arranged in the intake pipe 3 and in the exhaust pipe 8, respectively, so as to throttle the passages of the intake and exhaust pipes 3 and 8 when the air-fuel ratio of the exhaust gas is rendered rich. Therefore, the overall air amount can be reduced and deterioration of the fuel consumption ratio at a low air-fuel ratio can be further improved.

The exhaust gas recirculation device 12 is interposed between the feed pipe 4 and the exhaust manifold 7 so as to mix the exhaust gas into the intake air when the air-fuel ratio of the exhaust gas is rendered rich. Consequently, the fuel injection amount can be reduced, the fuel consumption ratio can be improved and combustion can be stabilized.

Figure 3:
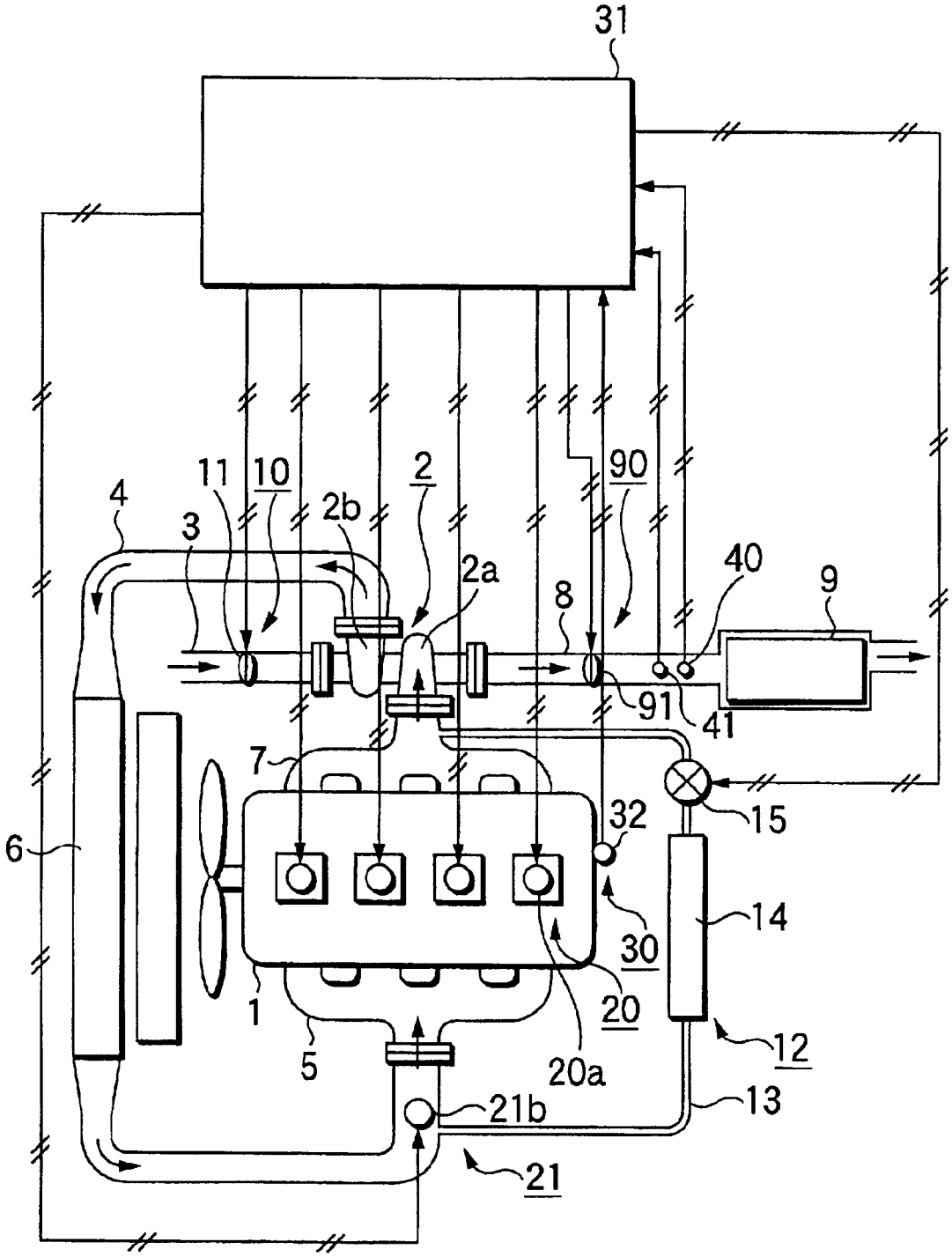
FIG. 3 is a conceptual view of a Diesel engine with a denitration device, which engine has a fuel injection controlling apparatus for an engine according to a second embodiment of the invention.

FIG. 3 is a conceptual view of a Diesel engine with an exhaust de NOx device that includes the fuel injection controlling apparatus according to the second embodiment of the invention. Like reference numerals are used in the drawing to identify like constituent members as in the first embodiment. The explanation of such members will be omitted but will be given on only different portions. An inter-intake pipe injector 21*b* is fitted to the intake pipe 4 in the proximity of the inlet of the intake manifold 5 so as to normally inject the fuel during the engine operation. Since the functions and effects are the same as those of the first embodiment, the explanation will be omitted.

Figure 4:
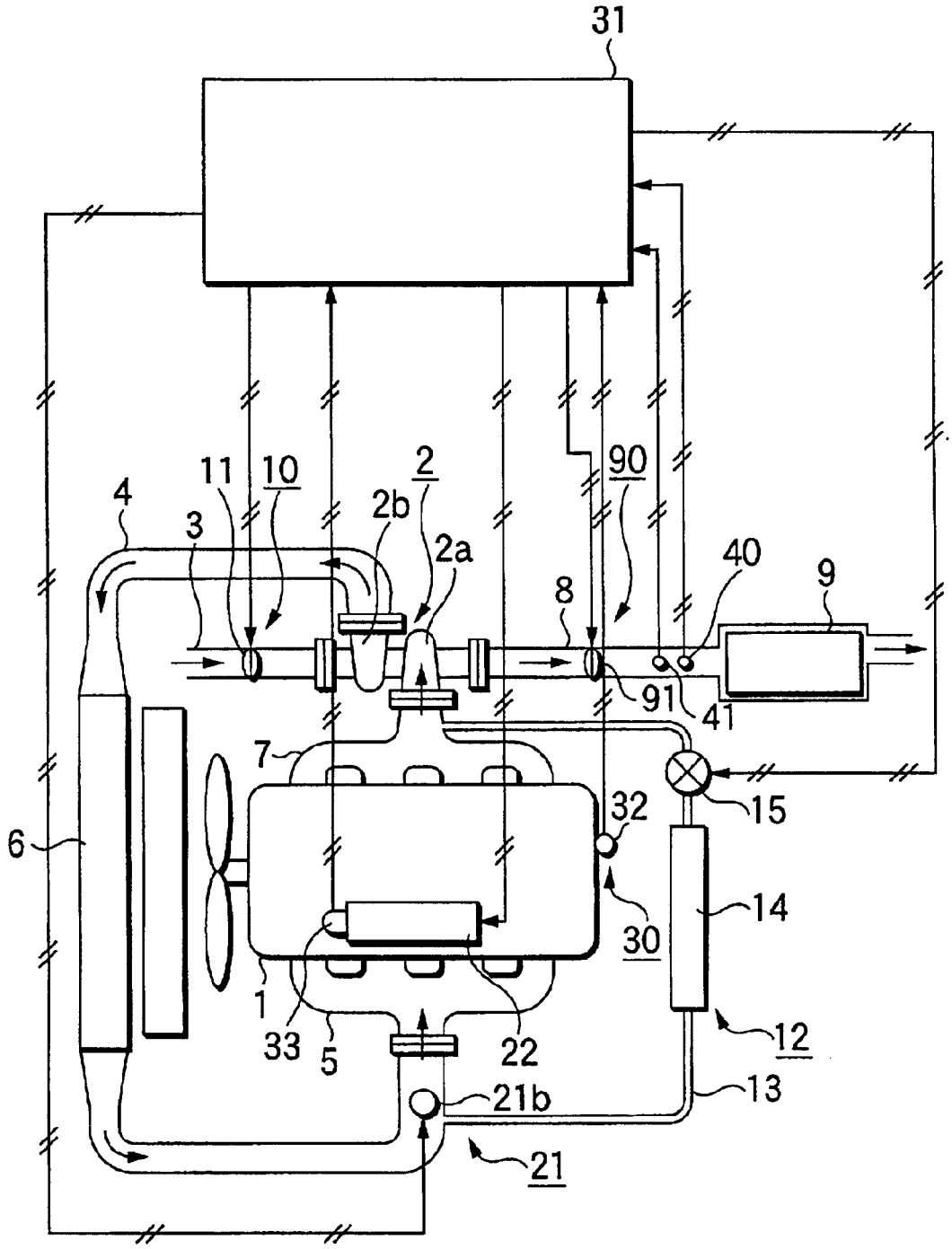
FIG. 4 is a conceptual view of a Diesel engine with a denitration device, which engine has a fuel injection controlling apparatus for an engine according to a third embodiment of the invention.

FIG. 4 is a conceptual view of a Diesel engine with an exhaust denitration device that includes the fuel injection controlling apparatus according to the third embodiment of the invention. Like reference numerals are used in the drawing to identify like constituent members as in the second embodiment. The explanation of such members will be omitted but will be given on only different portions. A straight type fuel injection pump 22 for supplying the fuel to each cylinder is provided to the engine 1. This in-line type fuel injection pump 22 includes a rack position sensor 33. The in-line type fuel injection pump 22 and the rack position sensor 33 are connected to the controller 31. The controller 31 calculates the engine load on the basis of the detection signals from the rack position sensor 33 and from the speed sensor 32. The controller 31 outputs the control signal to the in-line type fuel injection pump 22 and controls the fuel injection amount. The rest of the functions and effects are the same as those of the first embodiment, and their explanation will be omitted.

In the third embodiment, the fuel injection amount is detected from the detection signal of the rack position sensor 33 but it may be detected from a fuel control lever or from a stroke of an acceleration pedal. In the case of a common rail type fuel injection apparatus, the fuel injection amount can be detected by controlling the opening/closing time of a three-way valve of the injection nozzle.

What is claimed is:

1. A fuel injection controlling apparatus for a Diesel engine including first fuel injection means for supplying a fuel into cylinders and second fuel injection means for supplying the fuel to an intake passage, for conducting lean combustion under a normal operating condition, said fuel injection controlling apparatus comprising:

engine load detection means: and a controller for inputting a detection signal from said engine load detection means based on engine speed and a fuel injection amount, and causing said first fuel injection means to inject the fuel into the cylinders when an engine load is in a high load zone and said second fuel injection means to inject the fuel into said intake passage when the engine load is in a low load zone, said controller also causing both of said first and second fuel injection means to inject the fuel when the engine load is inside a predetermined boundary zone between a high load zone and a low load zone.

2. A fuel injection controlling apparatus for an engine according to claim 1, which further comprises:

a NOx absorption/reduction catalyst disposed in an exhaust passage, for absorbing NOx when an air-fuel ratio of an exhaust gas is lean, and emitting NOx when the air-fuel ratio of the exhaust gas is rich;

wherein said controller causing said second fuel injection means to inject a predetermined amount of the fuel into the intake passage so that the air-fuel ratio of the exhaust gas attains a value approximate to a theoretical mixing ratio when said NOx absorption/reduction catalyst emits NOx.

3. A fuel injection controlling apparatus for an engine according to claim 1, which further comprises at least any one of intake throttle means and exhaust throttle means for reducing an intake air amount.

4. A fuel injection controlling apparatus for an engine according to claim 1, which further comprises an exhaust gas recirculation device for mixing the exhaust gas to intake air.

5. A fuel injection controlling apparatus for a Diesel engine including first fuel injection means for supplying a fuel into cylinders and second fuel injection means for supplying the fuel to an intake passage, for conducting lean combustion under a normal operating condition, said fuel injection controlling apparatus comprising:

engine load detection means;

a controller for inputting a detection signal from said engine load detection means, and causing said first fuel injection means to inject the fuel into the cylinders when an engine load is in a high load zone and said second fuel injection means to inject the fuel into said intake passage when the engine load is in a low load zone, and a NOx absorption/reduction catalyst disposed in an exhaust passage, for absorbing NOx when an air-fuel ratio of an exhaust gas is lean, and emitting NOx when the air-fuel ratio of the exhaust gas is rich;

wherein said controller causing said second fuel injection means to inject a predetermined amount of the fuel into the intake passage so that the air-fuel ratio of the exhaust gas attains a value approximate to a theoretical mixing ratio when said NOx absorption/reduction catalyst emits NOx.

6. A fuel injection controlling apparatus for a Diesel engine including first fuel injection means for supplying a fuel into cylinders and second fuel injection means for supplying the fuel to an intake passage, for conducting lean combustion under a normal operating condition, said fuel injection controlling apparatus comprising:

engine load detection means;

a NOx absorption/reduction catalyst disposed in an exhaust passage, for absorbing NOx when an air-fuel ratio of an exhaust gas is lean, and emitting NOx when the air-fuel ratio of the exhaust gas is rich;

at least any one of intake throttle means and exhaust throttle means for reducing an intake air amount; and a controller for inputting a detection signal from said engine load detection means, causing said first fuel injection means to inject the fuel into the cylinders when an engine load is in a high load zone and said second fuel injection means to inject the fuel into said intake passage when the engine load is in a low load zone, and causing said second fuel injection means to inject a predetermined amount of the fuel into the intake passage so that the air-fuel ratio of the exhaust gas attains a value approximate to a theoretical mixing ratio when said NOx absorption/reduction catalyst emits NOx.

7. A fuel injection controlling apparatus for an engine according to claim 6, wherein said controller causes both of said first and second fuel injection means to inject the fuel when the engine load is inside a predetermined boundary zone between a high load zone and a low load zone.

8. A fuel injection controlling apparatus for an engine according to claim 6, which further comprises an exhaust gas recirculation device for mixing the exhaust gas to intake air.

9. A fuel injection controlling apparatus for a Diesel engine including first fuel injection means for supplying a fuel into cylinders and second fuel injection means for supplying the fuel to an intake passage, for conducting lean combustion under a normal operating condition, said fuel injection controlling apparatus comprising:

engine load detection means;

a NOx absorption/reduction catalyst disposed in an exhaust passage, for absorbing NOx when an air-fuel ratio of an exhaust gas is lean, and emitting NOx when the air-fuel ratio of the exhaust gas is rich;

an exhaust gas recirculation device for mixing the exhaust gas to intake air; and a controller for inputting a detection signal from said engine load detection means, and causing said first fuel injection means to inject the fuel into the cylinders when an engine load is in a high load zone and said second fuel injection means to inject the fuel into said intake passage when the engine load is in a low load zone;

wherein said controller also causing said second fuel injection means to inject a predetermined amount of the fuel into the intake passage so that the air-fuel ratio of the exhaust gas attains a value approximate to a theoretical mixing ratio when said NOx absorption/reduction catalyst emits NOx.

10. A fuel injection controlling apparatus for an engine according to claim 9, wherein said controller further causes both of said first and second fuel injection means to inject the fuel when the engine load is inside a predetermined boundary zone between a high load zone and a low load zone.

* * * * *